US005996335A

United States Patent [19]

Ebel

[11] Patent Number: 5,996,335

[45] Date of Patent: Dec. 7, 1999

[54] HEAD PART OF AN ANNULAR COMBUSTION CHAMBER OF A GAS TURBINE HAVING A HOLDING PART TO SECURE A BURNER COLLAR IN A BAYONET-CATCH TYPE MANNER

[75] Inventor: Michael Ebel, Rangsdorf, Germany

[73] Assignee: BMW Rolls-Royce GmbH, Oberursel, Germany

[21] Appl. No.: 08/945,518

[22] PCT Filed: Apr. 23, 1996

[86] PCT No.: PCT/EP96/01687

§ 371 Date: Feb. 9, 1998

§ 102(e) Date: Feb. 9, 1998

[87] PCT Pub. No.: WO96/34234

PCT Pub. Date: Oct. 31, 1996

[30] Foreign Application Priority Data

Apr. 27, 1995 [DE] Germany ..... 195 15 537

[51] Int. Cl.[6] ..... F23R 3/20; F23R 3/28

[52] U.S. Cl. ..... 60/39.32; 60/740; 60/752

[58] Field of Search ..... 60/39.31, 39.32, 60/740, 752, 756

[56] References Cited

U.S. PATENT DOCUMENTS

| | | | |
|---|---|---|---|
| 4,262,486 | 4/1981 | Russell . | |
| 4,322,945 | 4/1982 | Peterson et al. . | |
| 4,870,818 | 10/1989 | Suliga | 60/756 |
| 4,934,145 | 6/1990 | Zeisser | 60/756 |
| 4,999,996 | 3/1991 | Duchene et al. | 60/39.32 |
| 5,129,231 | 7/1992 | Becker et al. | 60/756 |
| 5,222,358 | 6/1993 | Chaput et al. | 60/39.32 |
| 5,253,471 | 10/1993 | Richardson . | |
| 5,271,219 | 12/1993 | Richardson | 60/756 |
| 5,419,115 | 5/1995 | Butler et al. . | |
| 5,577,379 | 11/1996 | Johnson | 60/39.31 |

FOREIGN PATENT DOCUMENTS

| | | |
|---|---|---|
| 31 13 382 | 4/1982 | Germany . |
| 44 27 222 | 2/1996 | Germany . |
| 2257502 | 1/1993 | United Kingdom . |
| WO 95/30115 | 11/1995 | WIPO . |

*Primary Examiner*—Ted Kim

*Attorney, Agent, or Firm*—Evenson, McKeown, Edwards & Lenahan, PLLC

[57] ABSTRACT

The holding of a burner collar as well as of a heat shield in the end wall of an annular combustion chamber is described. An annularly constructed holding part is provided which, in segments, has flanks between which the burner collar is held by lugs arranged thereon. The holding part is placed on a ring attachment of the heat shield and, together with the heat shield, is screwed to the end wall.

7 Claims, 2 Drawing Sheets

HEAD PART OF AN ANNULAR COMBUSTION CHAMBER OF A GAS TURBINE HAVING A HOLDING PART TO SECURE A BURNER COLLAR IN A BAYONET-CATCH TYPE MANNER

This is a 371 of PCT/EP96/01687 filed Apr. 23, 1996.

BACKGROUND AND SUMMARY OF THE INVENTION

The invention relates to a head part of an annular gas turbine combustion chamber, in whose end wall burner collars, which each accommodate a burner, are arranged in an annular fashion. The burners are each radially displaceably positioned through the use of a holding part which is fastened on the end wall together with a heat shield which is inserted into the passage opening for the burner collar and covers the end wall back side 2*a* toward the combustion chamber. In this case, the annularly constructed holding part, at least in segments, has flanks between which the burner collar is held using lugs arranged thereon. The holding part is placed on a ring attachment of the heat shield situated on the end wall front side.

With respect to the known state of the art, reference is first made to German Patent document DE 31 13 382 C2 (having a corresponding U.S. Pat. No. 4,322,945). In the case of the annular combustion chamber known from this document, the heat shield has a so-called attachment ring of a U-shaped cross-section which is held in the passage opening for the burner collar. However, in order to be able to mount this heat shield attachment ring at all, it must be constructed in two parts and, after the mounting has taken place, the two parts are welded together from the two sides of the end wall. In this known patent document, an edged connection is suggested as an alternative. However, both process steps, that is, the welding and the edging, require relatively high expenditures.

In contrast, the arrangement of burner collars illustrated in British Patent document GB-A-2 257 502 is easier to mount, particularly while avoiding weld seams. According to that document, each burner collar is held by way of lugs arranged thereon between flanks, provided in segments, of an annularly constructed holding part. In this case, the final fastening takes place using an elastic ring to be inserted.

Under hard usage conditions, a reliable holding by way of the elastic ring cannot always be ensured.

There is therefore needed a head part of an annular combustion chamber of a gas turbine which is functionally more reliable.

The present invention meets this need by providing a burner collar which is held by way of its lugs in a bayonet-catch-type manner between the flanks of the holding part which, together with the heat shield, is screwed to the end wall. Advantageous embodiments and further developments are described herein.

The invention will be explained in detail by means of a preferred embodiment.

DETAILED DESCRIPTION OF THE DRAWINGS

Figure 1:
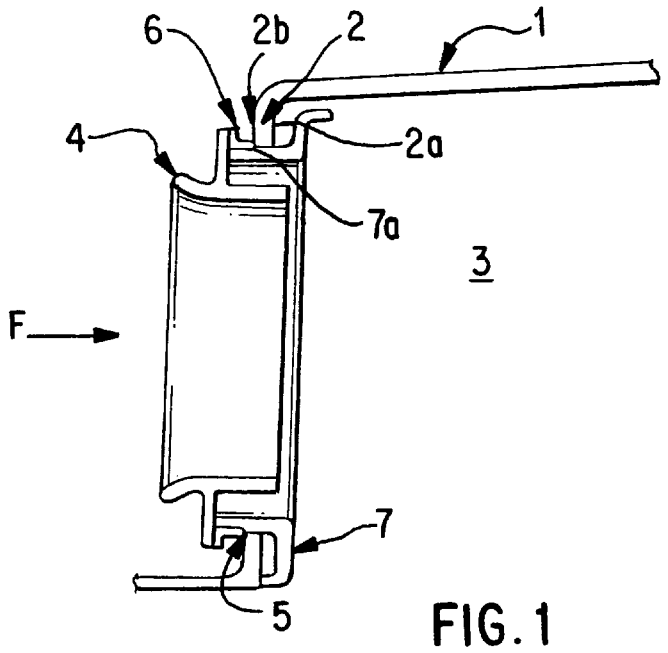
FIG. 1 is a partial sectional view of the head part of an annular combustion chamber in the area of an individual burner collar.

Reference number 1 indicates the exterior wall and reference number 2 indicates the end wall of an annular combustion chamber of a gas turbine which is conventional per se. FIG. 1 shows only the head part of this annular combustion chamber of the gas turbine, the combustion taking place in the actual combustion chamber 3 which, according to FIG. 1, is bounded on the left side by the end wall 2.

By way of several annularly arranged burners (which are not shown here) which are each held by a burner collar, fuel and air are introduced into the combustion chamber 3. A burner collar 4 of this type is illustrated in FIG. 1. This burner collar 4 is inserted into a passage opening 5 in the end wall 2 and is to be held in a radially displaceable manner. This radially displaceable positioning of the burner collar 4 takes place by means of a holding part 6 which, together with a conventional heat shield 7, is screwed to the end wall 2. The heat shield 7 is also inserted into the passage opening.

As usual, the heat shield 7 covers the back side (interior) of the end wall 2 which faces toward the actual combustion chamber 3. The heat shield 7 has a ring attachment 7*a* which, in a precisely fitting manner, is guided in the passage opening 5. In this case, a section of the ring attachment 7*a* comes to be situated on the front side (exterior) 2*b* of the end wall 2 so that the annularly constructed holding part 6 can be fitted or placed on this section of the ring attachment 7*a*.

Figure 2:
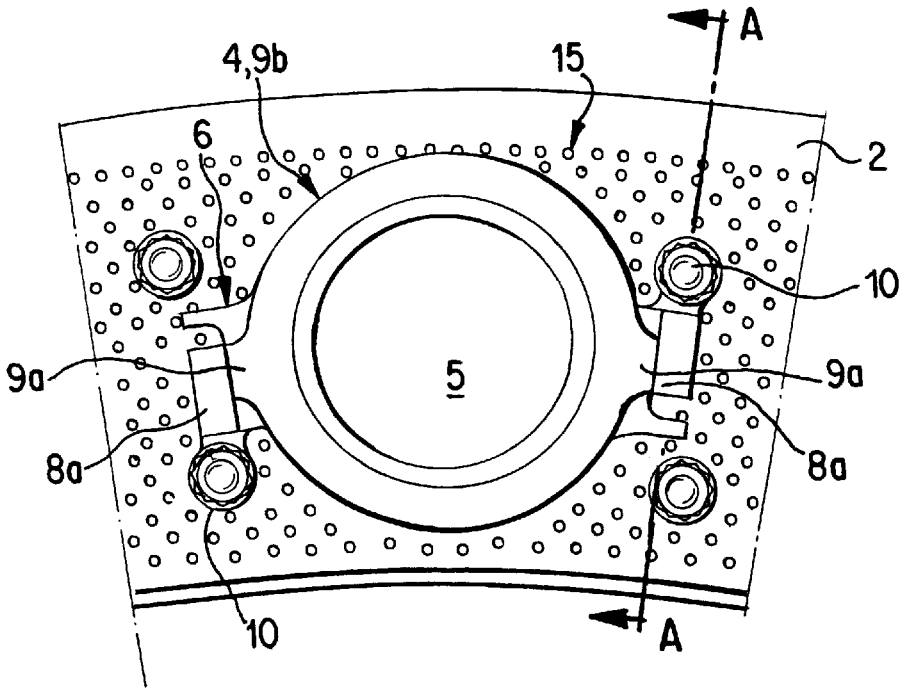
FIG. 2 is the view taken in the direction of arrow F of FIG. 1.
Figure 3:
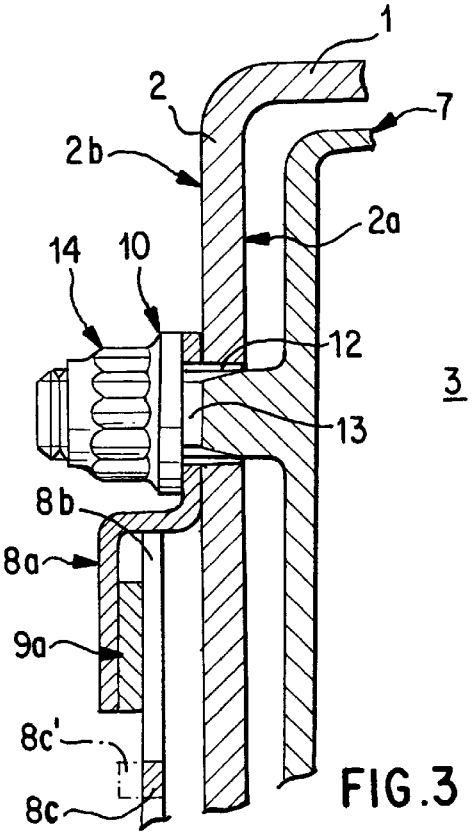
FIG. 3 is an enlarged view of a portion of the cut sectional view A—A in FIG. 2.
Figure 5:
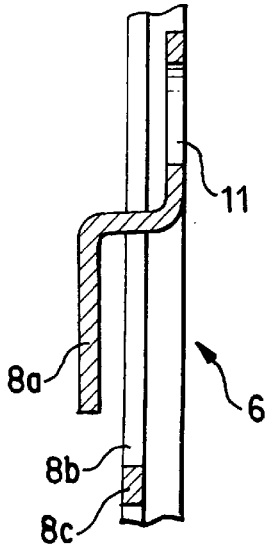
FIG. 5 again is the partial cut sectional view A—A, again with only the holding part being shown.
Figure 4:
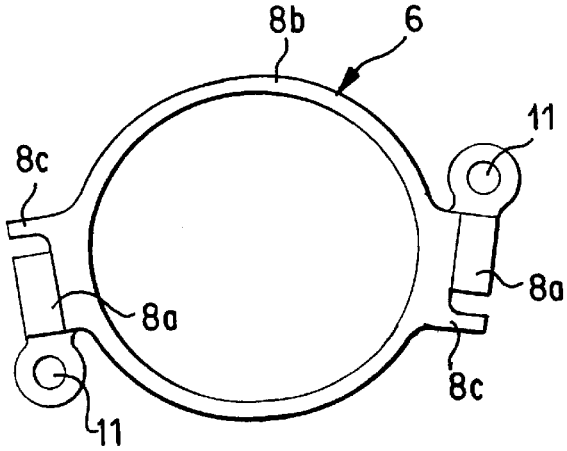
FIG. 4 again is the view taken in the direction of arrow F, with only the holding part being shown.
Figure 6:
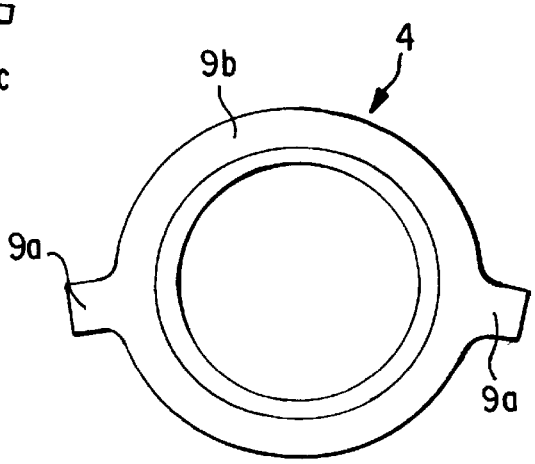
FIG. 6 is the view taken in the direction of arrow F, with only the burner collar being illustrated.

The annular shape of the holding part 6 is illustrated particularly in FIGS. 2 and 4. As illustrated in the sectional views of FIGS. 3 and 5, this holding part 6 has flanks 8*a*, 8*b* between which the burner collar 4 is held through the use of lugs 9*a* arranged on the burner collar 4. The construction of the lugs 9*a* is best shown in FIG. 6. As illustrated, the two lugs 9*a*, which each extend only along one segment or one sector of the annular burner collar 4, protrude from a surrounding web 9*b* of this burner collar 4.

The two flanks 8*a* of the holding part 6 situated in the same plane also extend only along a sector or segment of the annular holding part 6, while the second flank 8*b* also has a surrounding construction, as illustrated in FIGS. 1 and 4. Respective noses 8*c*, whose function will be explained below, are also provided in the area of the two flanks 8*a*.

Because of the segment-type construction or arrangement of the flanks 8*a* as well as of the lugs 9*a*, it is possible to insert the burner collar 4 into the holding part 6 in a bayonet-catch-type manner, in which case not only the lugs 9*a* but also the surrounding web 9*b* of the burner collar 4 come to rest on the surrounding flank 8*b* of the holding part. After a relative rotation of the two components with respect to one another, the lugs 9*a* will then finally be held between the two flanks 8*a* and 8*b*, a radial displaceability of the burner collar 4 being ensured with respect to the holding part 6. In order to prevent the burner collar 4 from rotating back out of the bayonet catch, after the mounting of the burner collar 4, the two noses 8*c* are bent (see 8*c*' of FIG. 3) up so that, in the case of a possible rotating (angular) movement, the lugs 9*a* come to rest against the noses 8*c*. Otherwise as shown, the noses 8*c* are in their open position, having not yet been bent up.

Finally, the holding part 6 can be screwed to the end wall 2, specifically together with the heat shield 7 which, for this purpose is provided with several stud bolts 13. Eyes 11 are provided on the flanks 8*a* of the holding part 6. In this case, these eyes 11 are arranged such that the holding part 6 on the front side 2*b* of the end wall 2 can be placed onto the stud bolts 13 fitted through the screw holes 12 in the end wall 2. The mounting takes place such that first the heat shield 7 is inserted from the direction of the end wall back side 2*a*. Then, the preassembled burner collar 4 with the holding part 6 is fitted on from the direction of the end wall front side 2*b*. Subsequently, the nuts 14 are screwed onto the stud bolts 13, whereby the screwed connection is formed which, as a whole, has the reference number 10. The burner collar 4 is therefore fastened in a very simple manner and in the process is positioned to be radially displaceable.

However, the described arrangement is not only distinguished by a small number of components while providing on extremely simple mounting, but it also has additional functional advantages. As illustrated in FIG. 2, as usual, a plurality of cooling air openings 15 are provided in the end wall 2. By way of these cooling air openings 15, cooling air is supplied to the thermally highly stressed components in the combustion chamber. Particularly the back side of the heat shield 7 which faces the end wall 2 is therefore cooled. As illustrated, with the exception of the areas directly behind the surrounding web 9*b* as well as the areas of the flanks 8*a*, a plurality of cooling air openings 15 can in this case be provided in the end wall 2 so that an optimal guiding of cooling air is permitted. In addition, an optimal cooling of the heat shield 7 is also made possible by the fact that no parts exist between the end wall 2 and the back side of the heat shield 7 which hinder an admission of cooling air to the heat shield 7.

An advantage of the described arrangement is also that the individual structural members can have a relatively simple design. Nevertheless, the highest functionality is ensured. In particular, by means of the illustrated arrangement, the sealing collar is pressed in the axial direction sufficiently firmly against the holding part 6 which, in turn, is disposed sufficiently sealingly on the ring attachment 7*a* of the heat shield 7. Since the latter is guided with a precise fit in the passage opening 5 in the end wall, by means of the illustrated arrangement, the volume of the combustion chamber 3 is sealed off sufficiently with respect to the dump diffuser situated in FIG. 1 on the left side of the front side 2*b* of the end wall 2. It should also be pointed out that naturally a plurality of details particularly of a constructive type may definitely be designed to deviate from the illustrated embodiment without leaving the content of the claims.

What is claimed is:

1. A head part of an annular gas turbine combustion chamber having an end wall with passage openings which each accommodate a burner, comprising:

a heat shield inserted into the passage opening and covering a back side of the end wall which faces toward the combustion chamber;

a holding part fastened on the end wall together with the heat shield;

a burner collar positioned within the passage opening in the end wall and being radially displaceable with respect to the holding part, said burner collar accommodating a respective burner;

wherein said holding part has an annular shape and, at least in segments, has flanks between which the burner collar is held via lugs arranged on said burner collar;

wherein said heat shield has a ring attachment on which the holding part is placed so as to be situated on a front side of the end wall;

wherein said burner collar is held via its lugs in a bayonet-catch-type manner between said flanks of said holding part, said holding part together with said heat shield being screwed to the end wall; and wherein in an area of said flanks, said holding part has noses which, after a bending, secure the burner collar against rotation.

2. The head part according to claim 1, wherein one of said flanks of said holding part facing the end wall surrounds the burner and others of said flanks assigned to said lugs of the burner collar are provided in an area of screwed connections.

3. The head part according to claim 2, wherein the screwed connection comprises stud bolts provided on the heat shield.

4. The head part according to claim 2, wherein the ring attachment of the heat shield precisely fits in the passage opening of the end wall.

5. The head part according to claim 1, wherein the screwed connection comprises stud bolts provided on the heat shield.

6. The head part according to claim 5, wherein the ring attachment of the heat shield precisely fits in the passage opening of the end wall.

7. The head part according to claim 1, wherein the ring attachment of the heat shield precisely fits in the passage opening of the end wall.

* * * * *